US006717550B1

(12) United States Patent
Aisenbrey

(10) Patent No.: US 6,717,550 B1
(45) Date of Patent: Apr. 6, 2004

(54) SEGMENTED PLANAR ANTENNA WITH BUILT-IN GROUND PLANE

(75) Inventor: Thomas Aisenbrey, Littleton, CO (US)

(73) Assignee: Integral Technologies, Inc., Bellingham, WA (US)

( * ) Notice: Subject to any disclaimer, the term of this patent is extended or adjusted under 35 U.S.C. 154(b) by 23 days.

(21) Appl. No.: 10/253,355

(22) Filed: Sep. 24, 2002

Related U.S. Application Data

(60) Provisional application No. 60/323,416, filed on Sep. 24, 2001.

(51) Int. Cl.[7] ..... H01Q 1/38
(52) U.S. Cl. ..... 343/700 MS; 343/846
(58) Field of Search ..... 343/700 MS, 767, 343/769, 770, 846

(56) References Cited

U.S. PATENT DOCUMENTS 4,779,097 A 10/1988 Morchin ..... 342/368
5,371,507 A 12/1994 Kuroda et al. ..... 343/700 MS
5,703,600 A 12/1997 Burrell et al. ..... 343/700 MS
6,133,880 A * 10/2000 Grangeat et al. .... 343/700 MS
6,355,703 B1 3/2002 Baba et al. ..... 522/182

* cited by examiner

*Primary Examiner*—Michael C. Wimer
(74) *Attorney, Agent, or Firm*—George O. Saile; Stephen B. Ackerman; Larry J. Prescott

(57) ABSTRACT

Antennas and methods of forming the antennas having a very low profile and a built in ground plane are described. The antenna elements are formed of conducting material on a layer of dielectric material, such as an integrated circuit board. The antenna elements are mounted on a ground plane having a number of shorting elements between one of the antenna elements and the ground plane. In some embodiments the antenna elements are on a single side of the layer of dielectric material. In other embodiments the antenna elements are formed on both the top and bottom surfaces of the layer of dielectric material. The self contained ground plane makes the antenna performance independent of proximity to conducting or non conducting surfaces.

35 Claims, 14 Drawing Sheets

SEGMENTED PLANAR ANTENNA WITH BUILT-IN GROUND PLANE

This Patent Application claims priority to the following U.S. Provisional Patent Application, herein incorporated by reference:

Ser. No. 60/324,416, filed Sep. 24, 2001

BACKGROUND OF THE INVENTION (1) Field of the Invention

This invention relates to low profile antennas having a built-in ground plane which provide good performance in close proximity to either a conducting or a non-conducting surface.

(2) Description of the Related Art

Antennas are an essential part of electronic communication systems that contain wireless links. Antenna performance is often adversely influenced by close proximity to conducting surfaces. Antennas which provide good performance in close proximity to either a conducting or a non-conducting surface offer significant advantages for these systems.

U.S. Pat. No. 5,371,507 to Kuroda et al. describes a planar antenna comprising a ground conductor, a dielectric layer laminated on the ground conductor, and a radiation element laminated on the dielectric layer.

U.S. Pat. No. 5,703,600 to Burrell et al. describes a microstrip antenna comprising a planar antenna radiating element, a ground plane, and a dielectric material placed between the radiating antenna element and the ground plane.

U.S. Pat. No. 6,355,703 to Chang et al. describes a microstrip patch antenna with enhanced beamwidth characteristics. The antenna comprises a patch element and a ground plane separated from the patch element by a first dielectric layer.

U.S. Pat. No. 4,779,097 to Morchin describes a segmented phased array antenna system for scanning two different ranges of directions with a single set of antenna elements.

SUMMARY OF THE INVENTION

Antennas are an essential part of electronic systems that contain wireless links. The performance of antennas is frequently affected by the environment in which they operate such as close proximity to conductors or conducting surfaces. Environmental degradation of performance is a significant disadvantages for antennas.

It is a principal objective of this invention to provide an antenna having antenna elements formed on a single side of a layer of dielectric material which has excellent performance in close proximity to either a conducting or a non-conducting surface.

It is another principal objective of this invention to provide an antenna having antenna elements formed on both the top surface and the bottom surface of a layer of dielectric material which has excellent performance in close proximity to either a conducting or a non-conducting surface.

It is another principal objective of this invention to provide a method of forming an antenna having antenna elements formed on a single side of a layer of dielectric material which has excellent performance in close proximity to either a conducting or a non-conducting surface.

It is another principal objective of this invention to provide a method of forming an antenna having antenna elements formed on both the top surface and the bottom surface of a layer of dielectric material which has excellent performance in close proximity to either a conducting or a non-conducting surface.

These objectives are achieved with a very low profile antenna that has a built-in ground plane. The antenna elements are formed by etching conducting material formed on an insulating material, such as an integrated circuit board. One set of implementations requires an insulating board with one side having a conducting material. Another set of implementations requires an insulating board with both sides having conducting materials. The antenna elements are mounted on a ground plane having a number of shorting elements between one of the antenna elements and the ground plane.

DESCRIPTION OF THE PREFERRED EMBODIMENTS

Figure 1A:
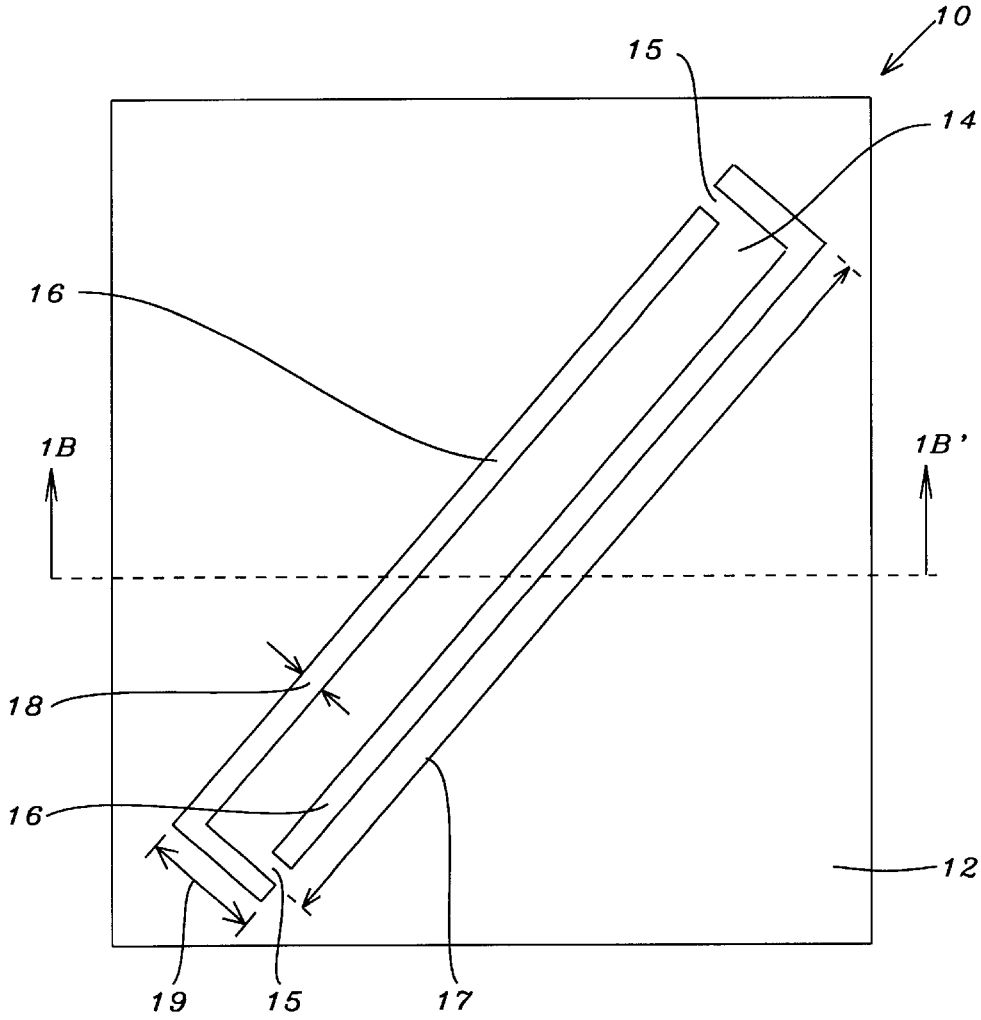
FIG. 1A shows a top view of the active part of an antenna of this invention using conducting material on a single side of an insulator board.
Figure 1B:
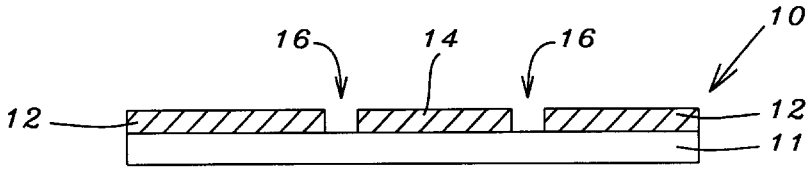
FIG. 1B shows a cross section view of the active part of the antenna shown in FIG. 1A, taken along line 1B–1B' of FIG. 1A.

Refer now to FIGS. 1A to 6B for a description of the preferred embodiments of this invention for antennas using a layer of dielectric material, such as an insulator board, having conductor material on a single side of the layer of dielectric material for the active part of the antenna. FIG. 1A shows a top view and FIG. 1B a cross section view of the active part of an antenna of this invention. The cross section shown in FIG. 1B is taken along line 1B–1B' of FIG. 1A. The active part of the antenna comprises a first antenna element 14 and a second antenna element 12 formed of conducting material. The first antenna element 14 and the second antenna element 12 comprise conducting material; such as aluminum, copper, or the like; formed on a layer of dielectric material 11. An insulating gap 16 separates the first antenna element 14 from the second antenna element 12. First shorting elements 15 form electrical connections between the first antenna element 14 and the second antenna element 12. In this example there are two first shorting elements 15. The two first shorting elements are narrow in width with locations affecting the optimum resonance frequency of the antenna as well as the impedance of the antenna resonance. In effect the two shorting elements 15 affect the inductance and capacitance of the active part of the antenna.

The length of the outer perimeter of the first antenna element 14 is a first distance and the length of the outer perimeter of the second antenna element 12 is a second distance. In this example the first antenna element 14 is a rectangle having a length 17 and a width 19. To realize resonance at the desired frequency, the perimeter of the first antenna element 14 (twice the length 17 plus twice the width 19) must be equal to a multiple of one quarter of the wavelength of the desired frequency. The length 17 and width 19 of the first antenna element 14 can vary, but as long as the perimeter, twice the length 17 plus twice the width 19, is a multiple of one quarter of the wavelength of the desired frequency the antenna will resonate at the desired frequency. In order to realize optimum performance of the antenna at the desired frequency, the outer perimeter of the second antenna element 12 must also be equal to a multiple of a quarter wavelength of the desired frequency. The active part of the antenna 10 is typically formed by etching a pattern in a layer of conducting material formed on a layer of dielectric material 11. A gap 16 of a third distance 18 separates the first antenna element from the second antenna element 12. In this example the third distance 18 is typically about 0.5 inches, however other values of the third distance 18, larger or smaller, are possible and can be used.

Figure 2A:
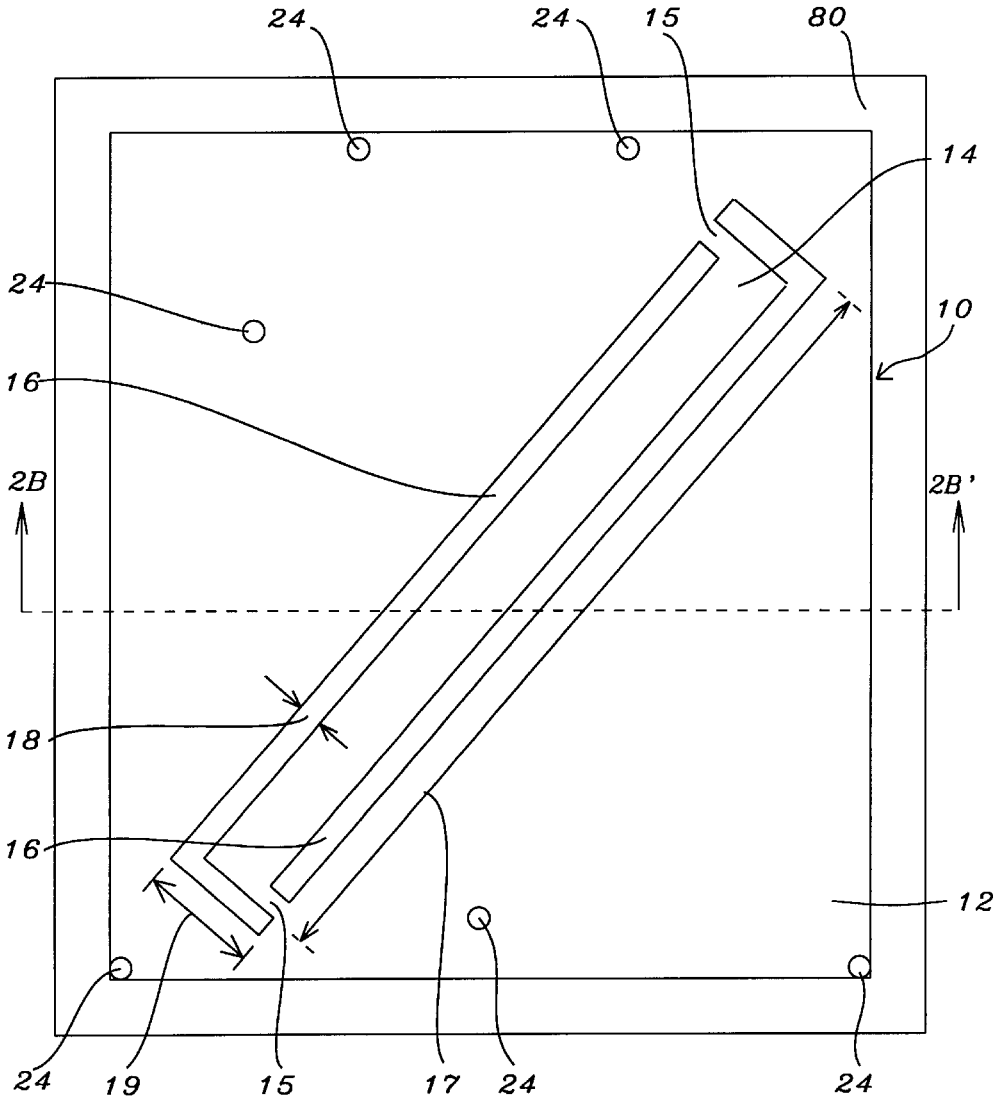
FIG. 2A shows a top view of an antenna of this invention using the active antenna part of the antenna shown in FIGS. 1A and 1B.
Figure 2B:
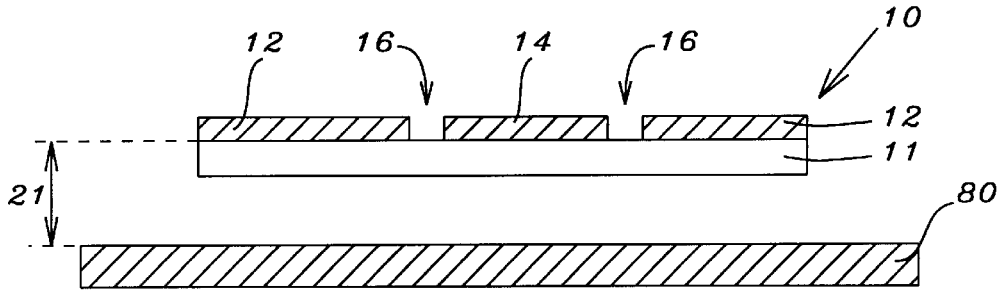
FIG. 2B shows a cross section view of the antenna of FIG. 2A taken along line 2B–2B' of FIG. 2A.

In the completed antenna the active part of the antenna 10 is positioned over a ground plane. FIG. 2A shows a top view and 2B shows a cross section view of the completed antenna with the active part of the antenna 10 positioned over the ground plane 80. FIG. 2B shows a cross section of the antenna shown in FIG. 2A taken along line 2B–2B' of FIG. 2A. The first antenna element 14 and the second antenna element 12 lie in a single plane which is parallel to the ground plane 80. The plane having the first antenna element 14 and the second antenna element 12 is a fourth distance 21 from the ground plane. The fourth distance 21 is between about 0.1 and 0.25 inches in a typical implementation, however the fourth distance 21 may vary, larger or smaller, for optimum performance at a given frequency. A number of second shorting elements 24 form electrical connections between the second antenna element 12 and the ground plane 80. As shown in FIG. 2A the second shorting elements 24 can be located either on the outer periphery or the interior of the second antenna element 12. The purpose of these shorting elements is to modify the capacitance and inductance of the active part of the antenna and thereby optimize the antenna impedance at the resonance frequency. In most cases the goal of this optimization is to realize an antenna impedance of 50 ohms.

Figure 2C:
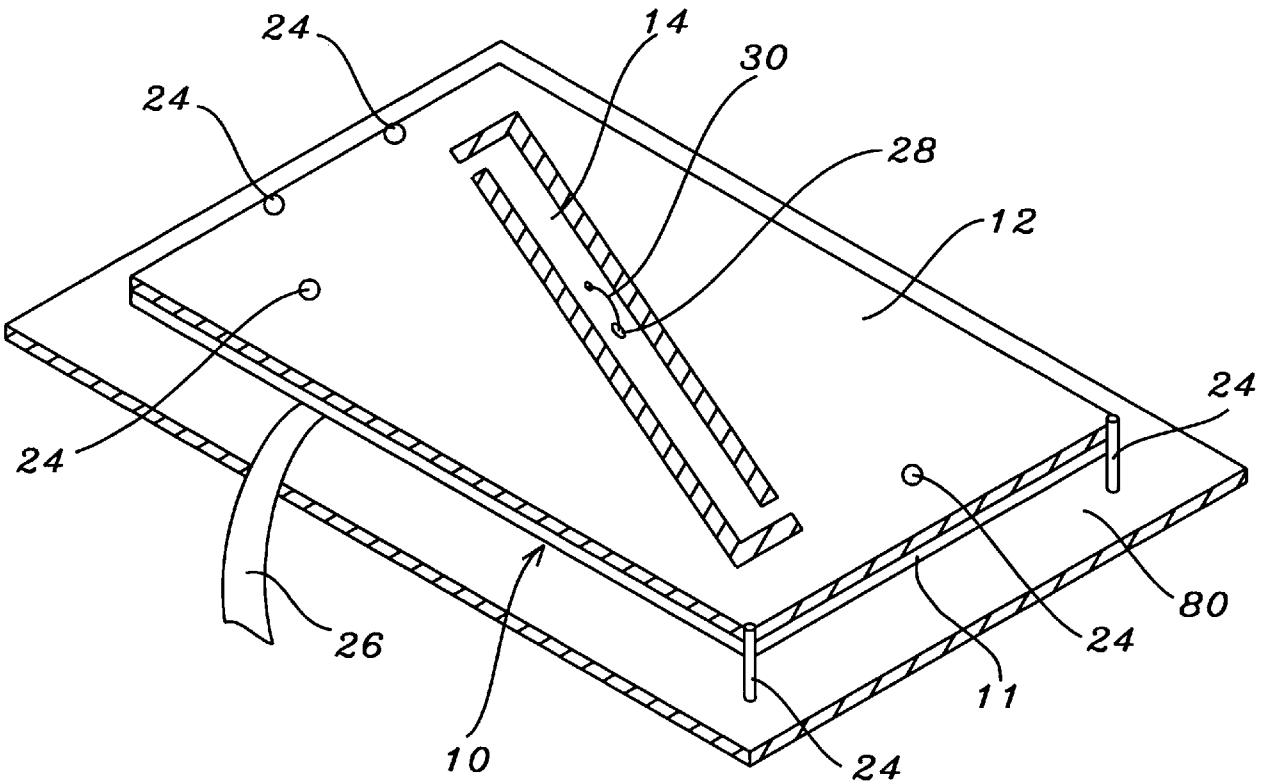
FIG. 2C shows a perspective view of the antenna shown in FIGS. 2A and 2B.

A perspective view of the antenna is shown in FIG. 2C. As shown in FIG. 2C electrical connection is made to the first antenna element 14 using a coaxial cable 26 having an outer shield, hidden from view in FIG. 2C and an center conductor 30. The coaxial cable 26 is routed between the active part of the antenna 10 and the ground plane 80 with the center conductor 30 passing through a hole 28 in the first antenna element 14 and electrically connected to the top surface of the first antenna element 14. The outer shield of the coaxial cable 26 is connected to the ground plane 80.

The antenna of this invention is very compact and has its own ground plane so that the antenna performance is not affected by proximity to either conducting or non conducting surfaces. The antenna of this embodiment is currently used for frequencies from about 100 megahertz (MHz) to about 3 gigahertz (GHz), but the same design concept can be used for frequencies as low as 3 kilohertz (KHz) and frequencies as high as 100 GHz. Specific product designs of this invention have been used at frequencies of 400 MHz, 850 MHz, 1500 MHz, 1900 MHz, and 2400 MHz.

Figure 3A:
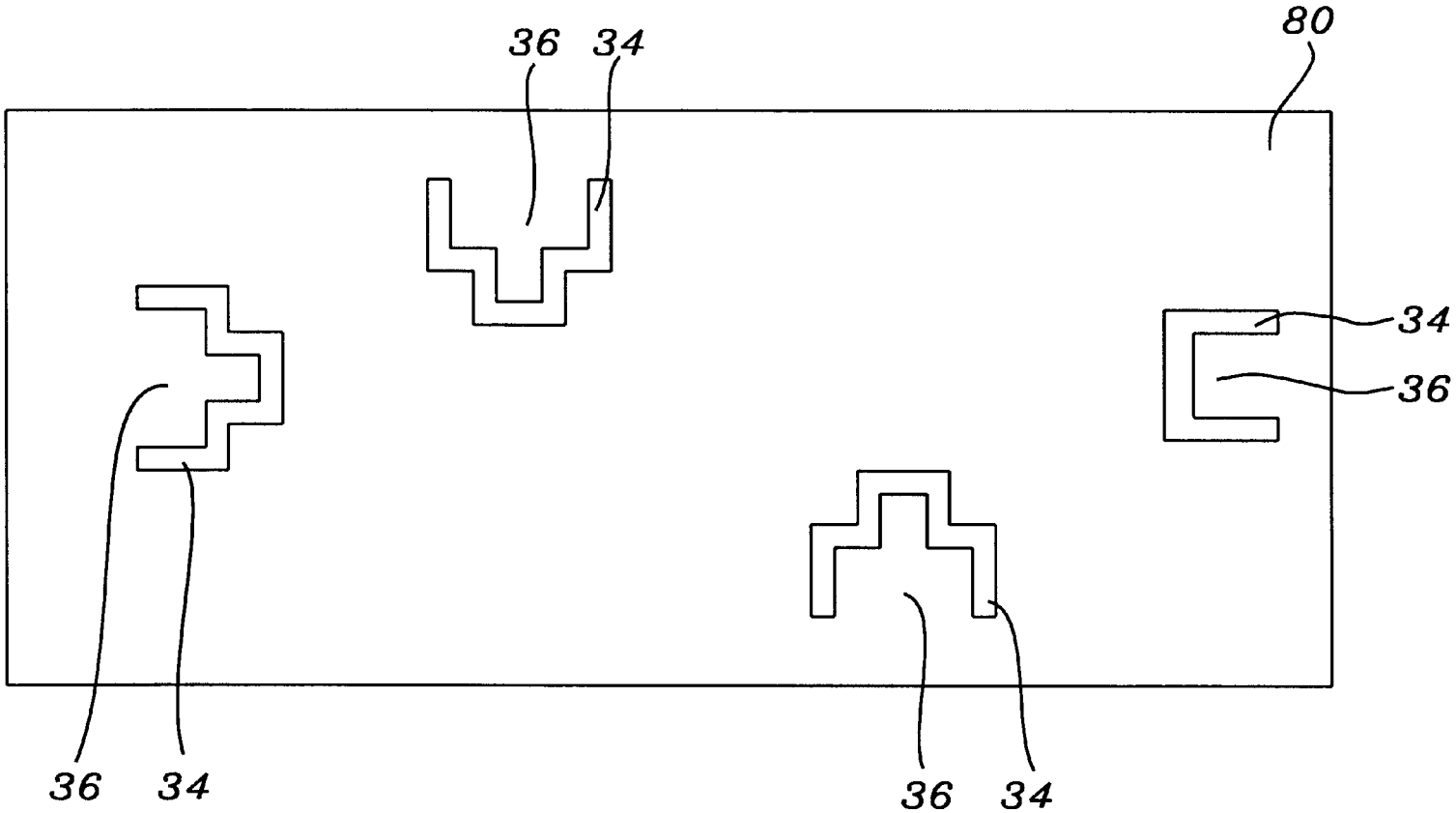
FIG. 3A shows a top view of a ground plane of this invention after shorting elements and standoff members have been delineated in the ground plane material.
Figure 3B:
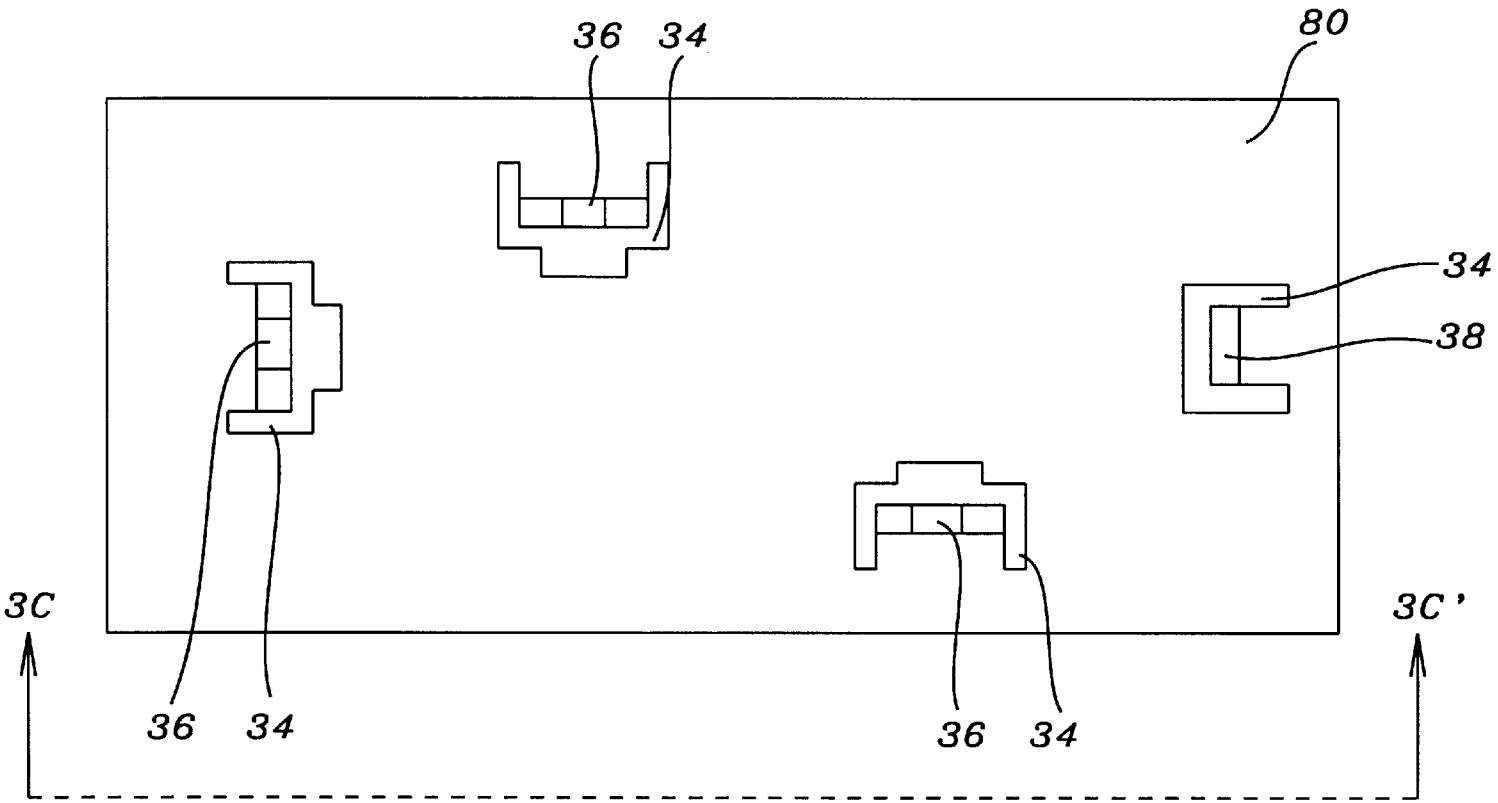
FIG. 3B shows a top view of the ground plane of FIG. 3A after the shorting elements and standoff members have been bent at 90° from the ground plane.
Figure 3C:
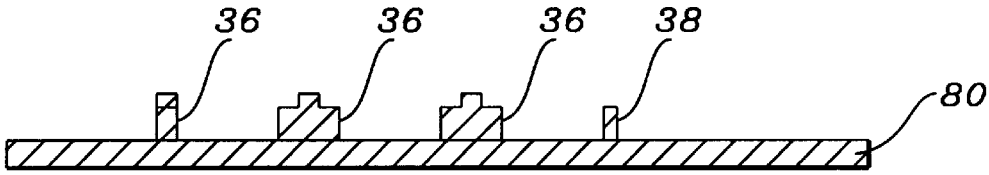
FIG. 3C shows a cross section view of the ground plane of FIG. 3B taken along line 3C–3C' in FIG. 3B.
Figure 4:
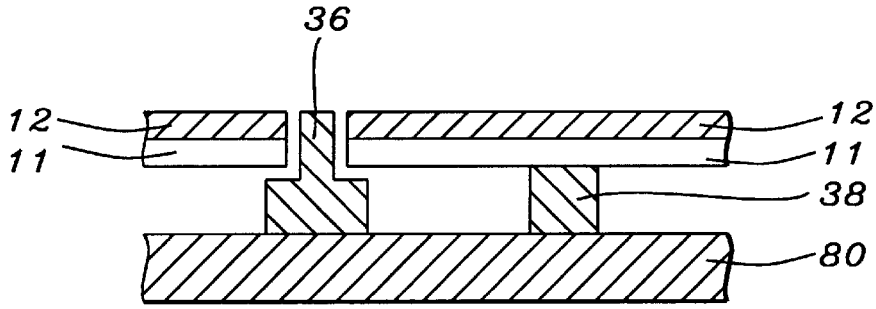
FIG. 4 shows a cross section view of part of the ground plane of FIGS. 3A–3C and part of the active part of an antenna showing electrical contact between the ground place and active part of the antenna and a mechanical standoff with insulation between the ground plane and the active part of the antenna.

FIGS. 3A, 3B, 3C, and 4 show an example of a method of forming the second shorting elements and mechanical standoffs holding the active part of the antenna in position relative to the ground plane. In this method, as shown in FIG. 3A, gaps 34 are cut in the ground plane 80 of form second shorting elements 36 and standoffs 38. As shown in FIGS. 3B and 3C the second shorting elements 36 and standoffs 38 are then bent at 90° to the ground plane 80. FIG. 3B shows a top view and FIG. 3C a side view, taken along line 3C–3C' of FIG. 3B, of the ground plane 80 after the second shorting elements 36 and standoffs 38 have been separated from the ground plane 80 and bent at 90°. FIG. 4 shows one of the second shorting elements 36 in position to be electrically connected to the second antenna element 12 and one of the standoffs 38 in contact with the dielectric layer 11.

Figure 5A:
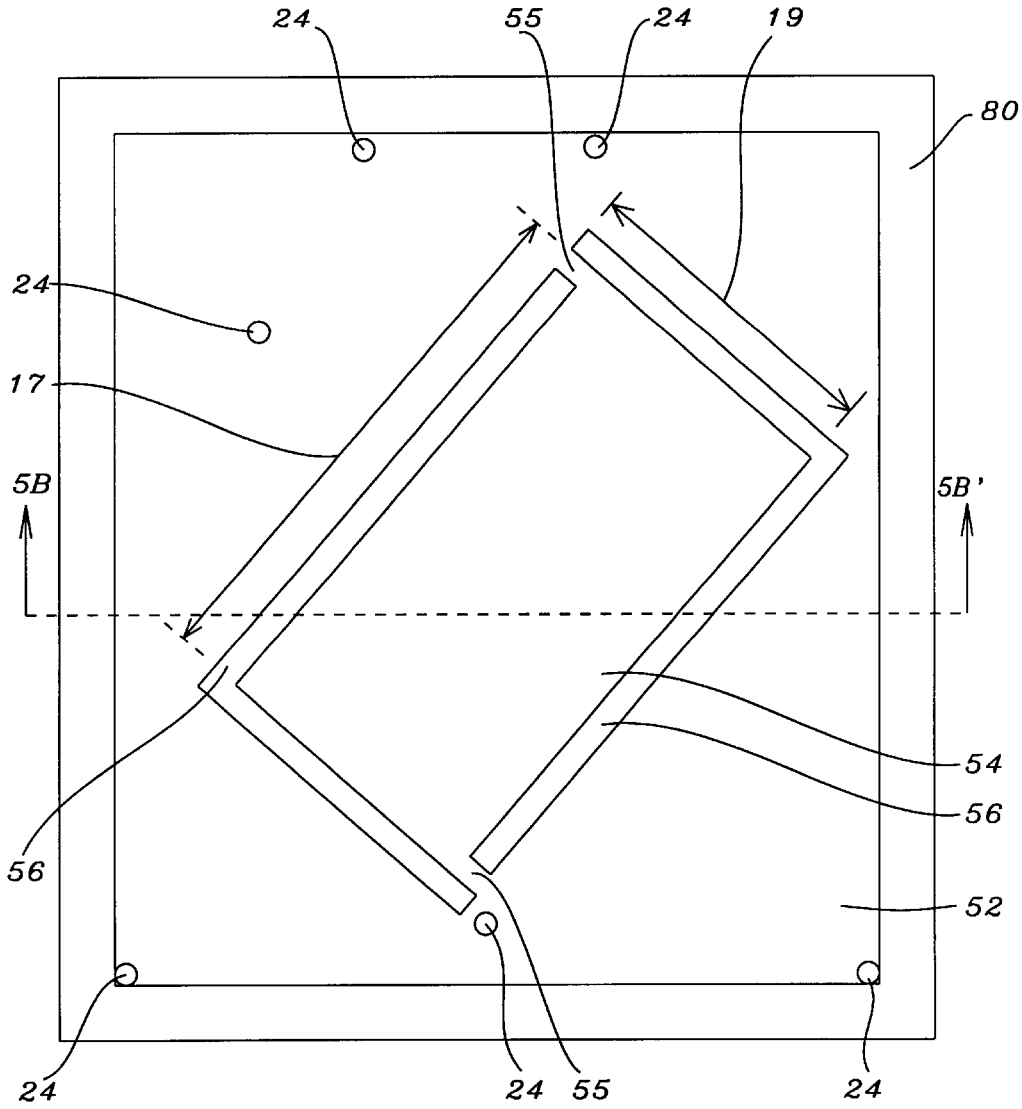
FIG. 5A shows a top view of a second antenna of this invention using conducting material on a single side of an insulator board.
Figure 5B:
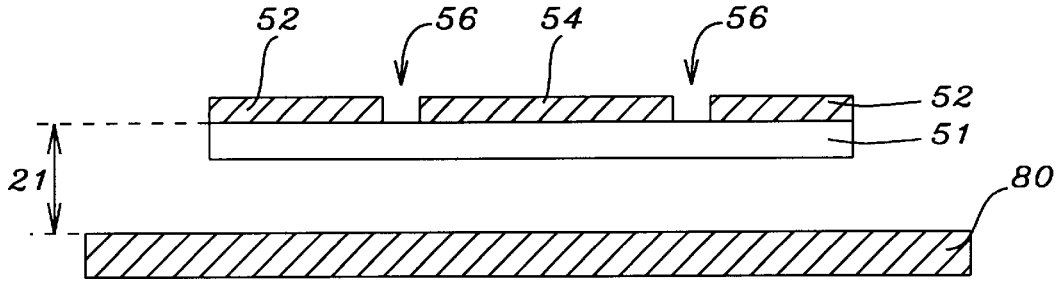
FIG. 5B shows a cross section view of the antenna of FIG. 5A taken along line 5B–5B' of FIG. 5A.

Other shapes can also be used for the first antenna element in this embodiment for frequencies between about 3 KHz and 30 GHz. FIGS. 5A shows a top view and 5B a cross section view, taken along line 5B–5B' of FIG. 5A, of an antenna having a rectangular first antenna element 54 with any ratio of the length 57 to width 59 which is practical to implement as long as the perimeter, twice the length 57 plus twice the width 59, is a quarter multiple of a quarter wavelength of the desired resonance frequency of the antenna. Also the outer perimeter of the second antenna element 52 must be equal to a multiple of a quarter wavelength of the desired resonance frequency for optimum antenna performance.

Also, as previously described, the impedance of the antenna is tuned by the number and location of the second shorting elements 24, and connections to the antenna are made using a coaxial cable routed and connected as previously described.

Figure 6A:
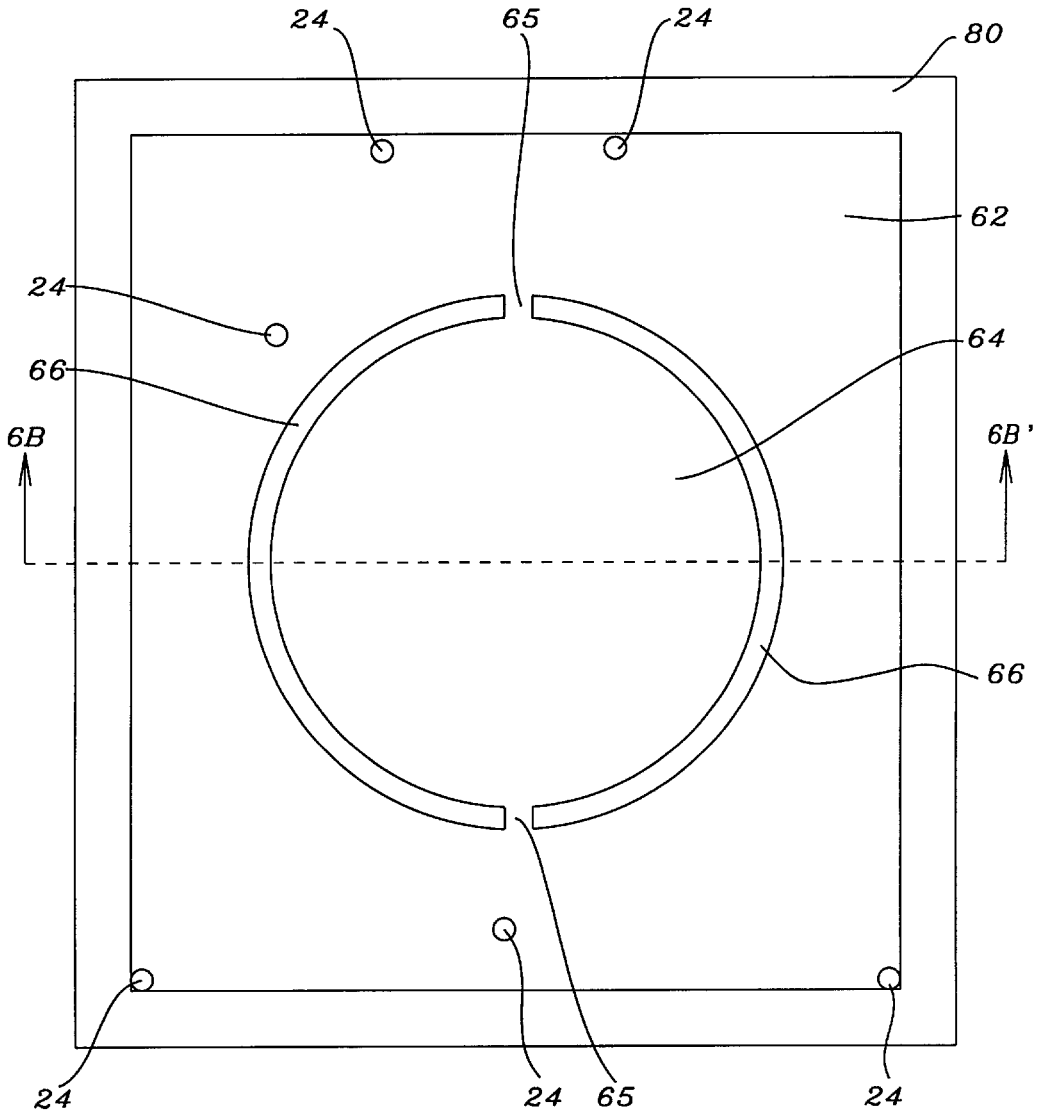
FIG. 6A shows a top view of a third antenna of this invention using conducting material on a single side of an insulator board.
Figure 6B:
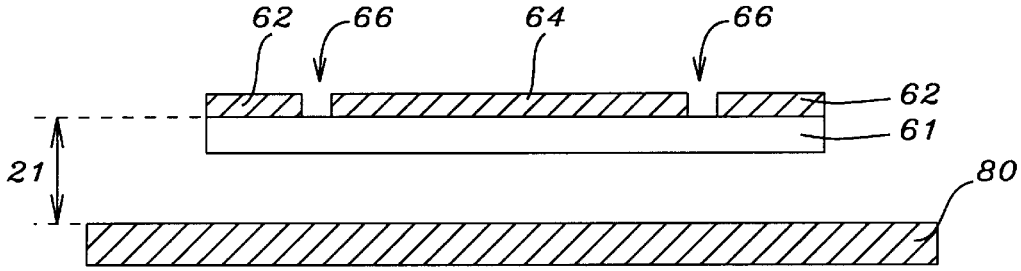
FIG. 6B shows a cross section view of the antenna of FIG. 6A taken along line 6B–6B' of FIG. 6A.

FIG. 6A shows a top view and 6B a cross section view, taken along line 6B–6B' of FIG. 6A, of an antenna having a circular first antenna element 64. The length of the outer perimeter of the first antenna element 64 is the first distance.

The length of the outer perimeter of the second antenna element 62 is the second distance. As previously described a gap 66 separates the first antenna element 64 from the second antenna element 62, first shorting elements 65 connect the first antenna element 64 and second antenna element 62, and second shorting elements 24 connect the second antenna element 62 to the ground plane 80. The first antenna element 64 and second antenna element 62 are co-planar and formed on a layer of dielectric 61. The first antenna element 64 and second antenna element 62 are the fourth distance 21 from the ground plane.

As previously described the first distance and second distance are integral multiples of a quarter wavelength, the impedance of the antenna is tuned by the number and location of the second shorting elements 24, and connections to the antenna are made using a coaxial cable routed and connected as previously described.

Although the spacing between the active part of the antenna and the ground plane has been shown as an air gap in these embodiments, other dielectric materials can be used. Any dielectric material having low dielectric losses at the frequencies of operation can be used. In these embodiments the first and second antenna elements are formed on a layer of dielectric material. One example of such a dielectric material is circuit board material, which provides low cost implementation in the range of frequencies from about 100 MHz to 5 GHz. At frequencies in the gigahertz range ceramic dielectric material can be used and multilayer ceramic can be used to provide both the dielectric layer and conducting layers. A frequencies where one quarter of a wavelength are in the millimeter range the antennas can be implemented in the wiring layers of an integrated circuit.

Figure 7A:
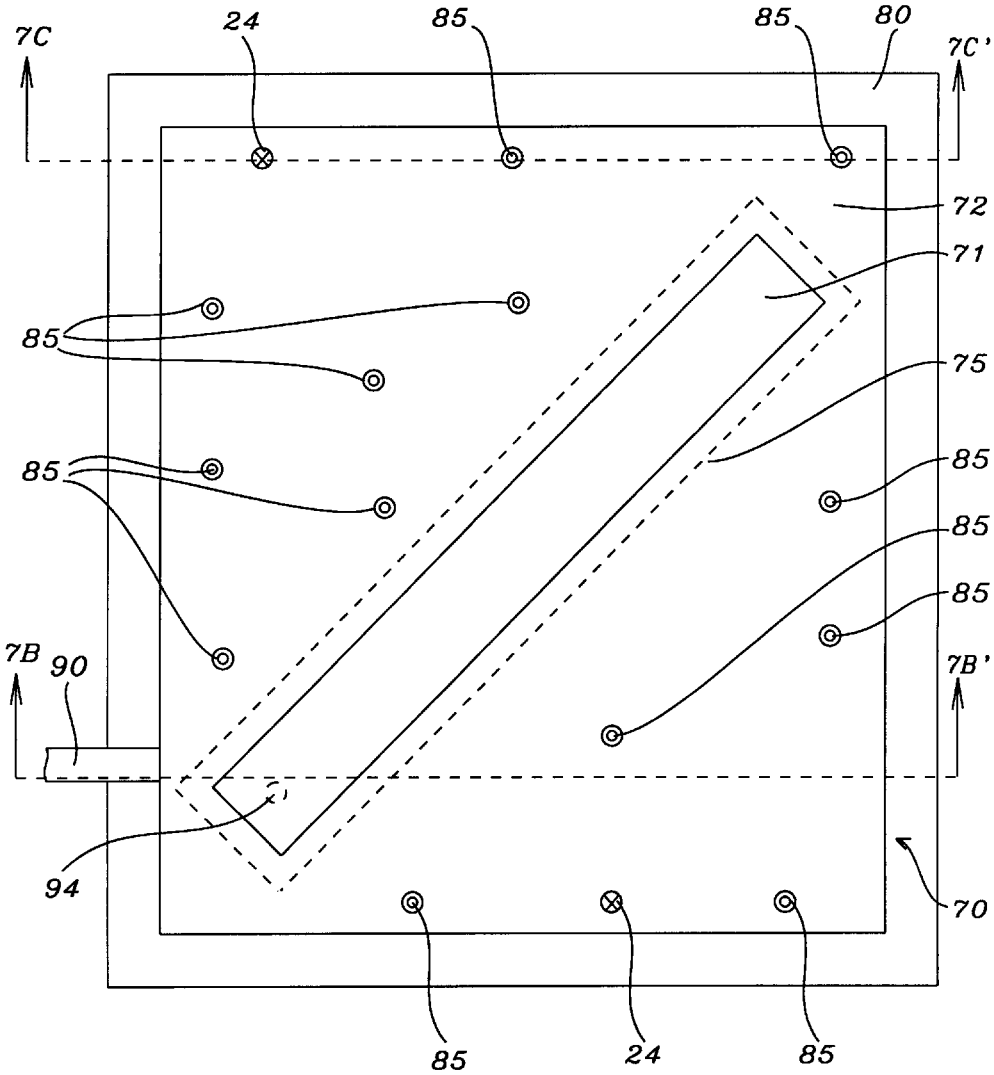
FIG. 7A shows a top view of an antenna of this invention using conducting material on a two sides of an insulator board.
Figure 7B:
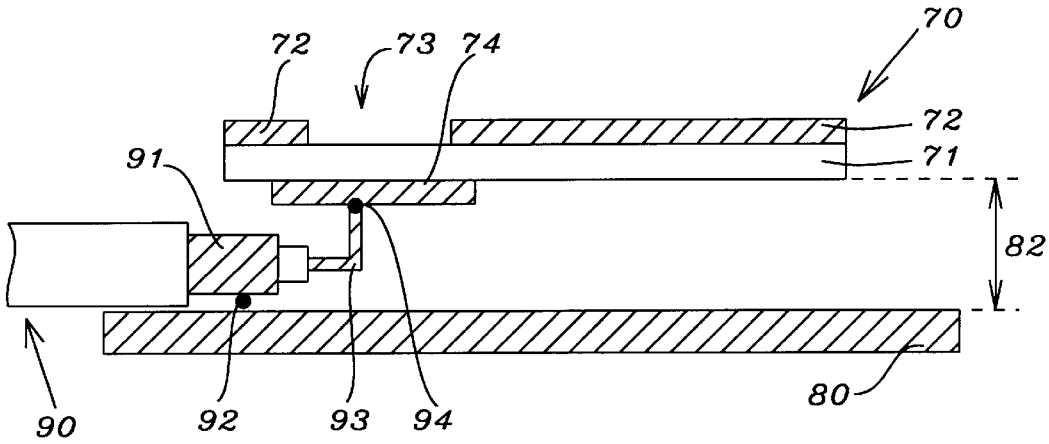
FIG. 7B shows a cross section view of the antenna of FIG. 7A taken along line 7B–7B' of FIG. 7A.
Figure 7C:
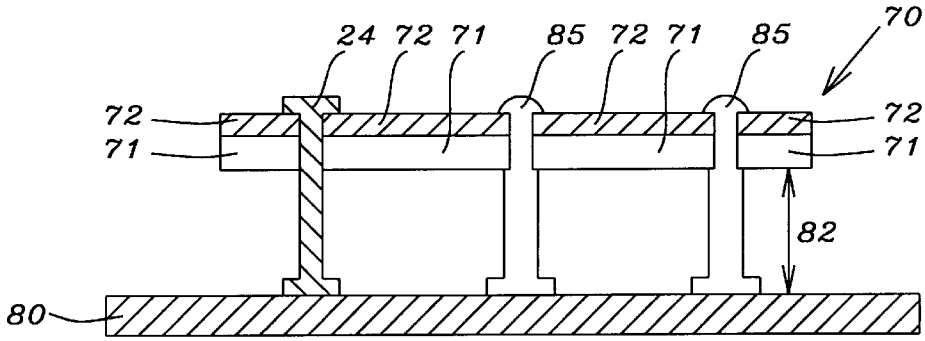
FIG. 7C shows a cross section view of the antenna of FIG. 7A taken along line 7C–7C' of FIG. 7A.
Figure 7D:
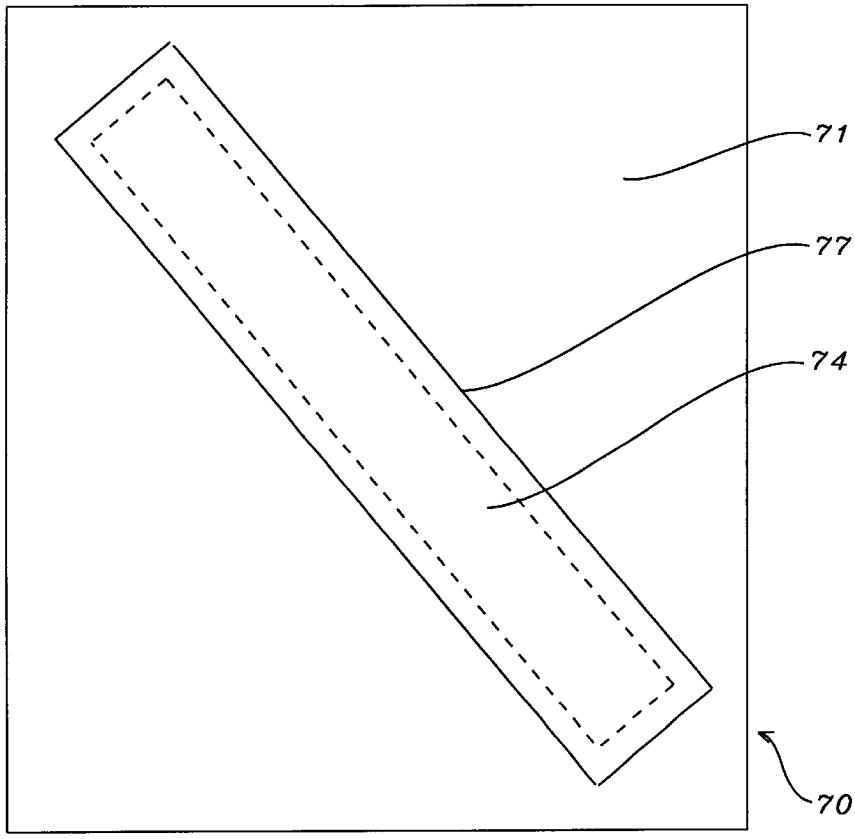
FIG. 7D shows the bottom view of the antenna of FIG. 7A without the ground plane, coaxial cable, insulating standoffs, or electrical connections between the ground plane and active part of the antenna.

Refer now to FIGS. 7A to 7D for a description of the preferred embodiment for antennas of this invention using a layer of dielectric material, such as insulator board, with conducting material on both the top surface and the bottom surface of the layer of dielectric material to form the active part of the antenna. As in the previous embodiment, the active part of the antenna 70 is positioned above a ground plane 80. The top view of the active part of the antenna 70 can be seen in FIG. 7A and the bottom view of the active part of the antenna 70 is shown in FIG. 7D. FIG. 7B shows a cross section view of the antenna taken along line 7B–7B', and FIG. 7C shows a cross section view of the antenna taken along line 7C–7C'.

In this embodiment the first antenna element 74 is formed on the bottom surface of a layer of dielectric material 71 and the second antenna element 72 is formed on the top surface of the layer of dielectric material 71. In FIG. 7A the outline of the outer perimeter of the first antenna element is shown by a dashed line 75. In FIG. 7C the outline of the inner perimeter of the second antenna element is shown by a dashed line 77. As can be seen in FIGS. 7A, 7B, and 7D the outer perimeter of the first antenna element 74 overlaps the inner perimeter of the second antenna element 72. As can be seen in FIGS. 7A and 7B a first electrical connection 94 connects the center conductor 93 of a coaxial cable 90 to the first antenna element 74 and a second electrical connection 92 connects the shield 91 of the coaxial cable to the ground plane 80. FIGS. 7A and 7B show that the coaxial cable and connections are located at one end of the first antenna element 74. The location of the first electrical connection 94, connecting the center conductor 93 of a coaxial cable 90 to the first antenna element 74, relative to the first antenna element 74 is shown by a dashed circle in FIG. 7A and a solid dot in FIG. 7B.

As shown in FIGS. 7A and 7C there are a number of second shorting elements 24 connecting the second antenna element 72 to the ground plane 80. In this example two second shorting elements 24 are shown but more or fewer can be used. Also shown in FIGS. 7A and 7C there are a number of insulating standoff elements 85 holding the active part of the antenna 70 is position relative to the ground plane 80 and maintaining a fourth distance 82 between the bottom of the layer of insulating material and the top of the ground plane 80. In this example thirteen insulating standoff elements 85 are shown but more or fewer can be used.

The capacitive coupling between the first antenna element 74 and the second antenna element 72, due to the overlap between the outer perimeter of the first antenna element 74 and the inner perimeter of the second antenna element 72, provides the electrical coupling necessary between the first antenna element 74 and the second antenna element 72. In this embodiment two second shorting elements 24 are used to provide electrical connection between the second antenna element 72 and the ground plane 80, however more or fewer second shorting elements 24 could be used. The capacitance of the overlap regions and the inductance modifications of the second shorting elements 24 optimize the antenna impedance at the resonance frequency. In most cases the goal of this optimization is to realize an antenna impedance of 50 ohms. The bottom of the layer of dielectric material 71 is a fourth distance 82 from the ground plane 80, see FIG. 2B. The fourth distance 82 is generally between about 0.1 and 0.5 inches, however the fourth distance 82 may vary, larger or smaller, for optimum performance at a given frequency.

As in the preceding embodiment, the length of the outer perimeter of the first antenna element 74, the first distance, is equal to an integral multiple of a quarter wavelength of the resonance frequency of the antenna. The length of the outer perimeter of the second antenna element 72, the second distance, is also equal to an integral multiple of a quarter wavelength of the resonance frequency of the antenna. The impedance of the antenna is tuned by the location of the two second shorting elements 24. Electrical connection to the antenna of this embodiment is made using a coaxial cable routed between the active part of the antenna 70 and the ground plane 80 with the center conductor electrically connected to the first antenna element 74 and the outer shield of the coaxial cable connected to the ground plane 80. The location and detail of the coaxial cable connections are shown in FIGS. 7A and 7B.

The antenna of this embodiment of the invention also has its own ground plane so that the antenna performance is not affected by proximity to either conducting or non conducting surfaces. The antenna of this embodiment is generally used for frequencies from about 100 MHz to about 5 GHz, but can also be scaled to be used at frequencies from 3 KHz to 100 GHz.

Although the spacing between the active part of the antenna and the ground plane has been shown as an air gap in these embodiments, other dielectric materials can be used. Any dielectric material having low dielectric losses at the frequencies of operation can be used. In these embodiments the first and second antenna elements are formed on a layer of dielectric material. One example of such a dielectric material is circuit board material, which provides low cost implementation in the range of frequencies from about 100 MHz to 5 GHz. At frequencies in the gigahertz range ceramic dielectric material can be used and multilayer ceramic can be used to provide both the dielectric layer and conducting layers. A frequencies where one quarter of a wavelength are in the millimeter range the antennas can be implemented in the wiring layers of an integrated circuit.

While the invention has been particularly shown and described with reference to the preferred embodiments thereof, it will be understood by those skilled in the art that various changes in form and details may be made without departing from the spirit and scope of the invention.

What is claimed is:

1. An antenna, comprising:

a layer of dielectric material having a top surface;

a first antenna element formed of conducting material on said top surface of said layer of dielectric material, wherein said first antenna element has an outer periphery having a length of a first distance;

a second antenna element formed of conducting material on said top surface of said layer of dielectric material, wherein said second antenna element surrounds said first antenna element, said second antenna element has an inner periphery, and said second antenna element has an outer periphery having a length of a second distance;

a gap of a third distance between said outer periphery of said first antenna element and said inner periphery of said second antenna element;

a number of first shorting elements wherein each of said first shorting elements form a conducting path between said first antenna element and said second antenna element;

a ground plane formed of conducting material wherein said ground plane is parallel to and a fourth distance below said top surface of said layer of dielectric material; and a number of second shorting elements wherein each of said second shorting elements form a conducting path between said second antenna element and said ground plane.

2. The antenna of claim 1 wherein said antenna has a resonance frequency and said first distance is equal to an integer multiplied by one quarter wavelength of said resonance frequency.

3. The antenna of claim 1 wherein said antenna has a resonance frequency and said second distance is equal to an integer multiplied by one quarter wavelength of said resonance frequency.

4. The antenna of claim 1 wherein said dielectric material is circuit board material.

5. The antenna of claim 1 wherein said dielectric material is ceramic material.

6. The antenna of claim 1 wherein said antenna has a resonance frequency between about 1 megahertz and 100 gigahertz.

7. The antenna of claim 1 wherein said antenna has a resonance frequency between about 3 kilohertz and 1 megahertz.

8. The antenna of claim 1 wherein said first antenna element is a rectangle.

9. The antenna of claim 1 wherein said first antenna element is a circle.

10. An antenna, comprising:

a layer of dielectric material having a first surface and a second surface wherein said first surface and said second surface are parallel and the distance between said first surface and said second surface is a third distance;

a first antenna element formed of conducting material on said second surface of said layer of dielectric material, wherein said first antenna element has an outer periphery having a length of a first distance;

a second antenna element formed of conducting material on said first surface of said layer of dielectric material, wherein said second antenna element has an inner periphery, said second antenna element has an outer periphery having a length of a second distance, and said outer periphery of said first antenna element overlaps said inner periphery of said second antenna element;

a ground plane formed of conducting material wherein said ground plane is parallel to and a fourth distance below said second surface of said layer of dielectric material; and a number of shorting elements wherein each of said shorting elements form a conducting path between said second antenna element and said ground plane.

11. The antenna of claim 10 wherein said number of shorting elements is two shorting elements.

12. The antenna of claim 10 wherein said antenna has a resonance frequency and said first distance is equal to an integer multiplied by one quarter wavelength of said resonance frequency.

13. The antenna of claim 10 wherein said antenna has a resonance frequency and said second distance is equal to an integer multiplied by one quarter wavelength of said resonance frequency.

14. The antenna of claim 10 wherein said dielectric material is circuit board material.

15. The antenna of claim 10 wherein said dielectric material is ceramic material.

16. The antenna of claim 10 wherein said antenna has a resonance frequency of between about 1 megahertz and 100 gigahertz.

17. The antenna of claim 10 wherein said antenna has a resonance frequency of between about 3 kilohertz and 1 megahertz.

18. The antenna of claim 10 wherein said first antenna element is a rectangle.

19. A method of forming an antenna, comprising:

providing a layer of dielectric material having a top surface;

forming a first antenna element of conducting material on said top surface of said layer of dielectric material, wherein said first antenna element has an outer periphery having a length of a first distance;

forming a second antenna element of conducting material on said top surface of said layer of dielectric material, wherein said second antenna element surrounds said first antenna element, said second antenna element has an inner periphery, said second antenna element has an outer periphery having a length of a second distance, said first antenna element and said second antenna element lie in the same plane, and there is a gap of a third distance between said outer periphery of said first antenna element and said inner periphery of said second antenna element;

forming a number of first shorting elements wherein each of said first shorting elements form a conducting path between said first antenna element and said second antenna element;

forming a ground plane of conducting material wherein said ground plane is parallel to and a fourth distance from said top surface of said layer of dielectric material; and forming a number of second shorting elements wherein each of said second shorting elements form a conducting path between said second antenna element and said ground plane.

20. The method of claim 19 wherein said antenna has a resonance frequency and said first distance is equal to an integer multiplied by one quarter wavelength of said resonance frequency.

21. The method of claim 19 wherein said antenna has a resonance frequency and said second distance is equal to an integer multiplied by one quarter wavelength of said resonance frequency.

22. The method of claim 19 wherein said dielectric material is circuit board material.

23. The method of claim 19 wherein said dielectric material is ceramic material.

24. The method of claim 19 wherein said antenna has a resonance frequency of between about 1 megahertz and 100 gigahertz.

25. The method of claim 19 wherein said antenna has a resonance frequency of between about 3 kilohertz and 1 megahertz.

26. The method of claim 19 wherein said first antenna element is a rectangle.

27. The method of claim 19 wherein said first antenna element is a circle.

28. A method of forming an antenna, comprising:

providing layer of dielectric material having a first surface and a second surface wherein said first surface and said second surface are parallel and the distance between said first surface and said second surface is a third distance;

forming a first antenna element of conducting material on said second surface of said layer of dielectric material, wherein said first antenna element has an outer periphery having a length of a first distance;

forming a second antenna element of conducting material on said first surface of said layer of dielectric material, wherein said second antenna element has an inner periphery, said second antenna element has an outer periphery having a length of a second distance, and said outer periphery of said first antenna element overlaps said inner periphery of said second antenna element;

forming a ground plane of conducting material wherein said ground plane is parallel to and a fourth distance below said second surface of said layer of dielectric material; and forming two shorting elements wherein each of said shorting elements form a conducting path between said second antenna element and said ground plane.

29. The method of claim 28 wherein said antenna has a resonance frequency and said first distance is equal to an integer multiplied by one quarter wavelength of said resonance frequency.

30. The method of claim 28 wherein said antenna has a resonance frequency and said second distance is equal to an integer multiplied by one quarter wavelength of said resonance frequency.

31. The method of claim 28 wherein said dielectric material is circuit board material.

32. The method of claim 28 wherein said dielectric material is ceramic material.

33. The method of claim 28 wherein said antenna has a resonance frequency of between about 1 megahertz and 100 gigahertz.

34. The method of claim 28 wherein said antenna has a resonance frequency of between about 3 kilohertz and 1 megahertz.

35. The method of claim 28 wherein said first antenna element is a rectangle.

* * * * *